US005911351A

United States Patent [19]

White

[11] Patent Number: 5,911,351

[45] Date of Patent: Jun. 15, 1999

[54] PNEUMATIC FASTENING DEVICE HAVING IMPROVED NOSE SEALING ARRANGEMENT

[75] Inventor: Brian M. White, Riverside, R.I.

[73] Assignee: Stanley Fastening Systems, L.P., East Greenwich, R.I.

[21] Appl. No.: 09/002,489

[22] Filed: Jan. 2, 1998

[51] Int. Cl.[6] ..... B25C 5/13

[52] U.S. Cl. ..... 227/130; 173/211

[58] Field of Search ..... 227/8, 10, 130, 227/156; 173/210, 211

[56] References Cited

U.S. PATENT DOCUMENTS

| | | | |
|---|---|---|---|
| 3,086,207 | 4/1963 | Lingle et al. | 227/130 |
| 5,020,712 | 6/1991 | Monacelli | 227/130 |
| 5,485,946 | 1/1996 | Jankel | 227/130 |
| 5,511,714 | 4/1996 | Bauer et al. . | |
| 5,711,471 | 1/1998 | White | 227/130 |
| 5,782,395 | 7/1998 | Sauer | 227/130 |
| 5,797,534 | 8/1998 | Almeras et al. | 227/130 |

*Primary Examiner*—Scott A. Smith

*Attorney, Agent, or Firm*—Pillsbury Madison & Sutro LLP

[57] ABSTRACT

A pneumatically operated fastener drive device that comprises a housing assembly including a nose assembly defining a fastener drive track. A cylinder is disposed in the housing assembly, and a resilient bumper is disposed towards a bottom of the cylinder. A drive piston is slidably and sealingly mounted in the cylinder for movement through an operative cycle. The drive piston engages the bumper at the end of the drive stroke. A fastener driving element is operatively connected to the piston for movement therewith and extends through an opening in the bumper. A valve arrangement is movable between a closed position and an opened position to effect movement of the piston and fastener driving element. An actuator and trigger member are operable to control the valve arrangement. The bumper has a sealing portion surrounding the opening in the bumper and disposed outwardly from the cylinder. The sealing portion has exterior surfaces disposed in engagement with adjacent surrounding surfaces of the nose assembly. The sealing portion is flexible outwardly under the force of air pressure within the cylinder below the piston during the return stroke of the piston so that the exterior surfaces of the sealing portion are biased in sealing relation with adjacent surrounding surfaces of the nose assembly.

9 Claims, 5 Drawing Sheets

PNEUMATIC FASTENING DEVICE HAVING IMPROVED NOSE SEALING ARRANGEMENT

BACKGROUND OF THE INVENTION

This invention relates to a pneumatic fastener driving device and, more particularly, to such a device having an improved nose sealing arrangement.

Conventional pneumatic fastening devices of the type contemplated herein include a valve arrangement moveable in response to actuation of a trigger from a closed position to an open position permitting air under pressure to communicate with a piston chamber for moving a piston and fastener driving element fixed thereto through a cylinder, thereby initiating a fastener drive stroke. The valve arrangement permits a single driving stroke upon actuation of the trigger, or automated cycling of the fastener device for repetitious operation. Fastener devices of the single drive stroke type can be standard, wherein the fastener driving element is moved to the bottom of its stroke upon actuation of the trigger, and to the top of its stroke upon release of the trigger. Alternatively, devices of the single drive stroke type can be of the full cycle type, wherein a drive stroke and return stroke of the fastener driving element occurs upon actuation of the trigger, and returns to the top of its stroke upon release of the trigger. In the automated fastening device type, a plurality of fastener drive strokes and return strokes are accomplished so long as the trigger continues to be actuated.

In any of these devices, the piston and fastener drive element is driven downwardly in a drive stroke by air pressure within the cylinder above the piston, and initiates a return stroke to the top of the cylinder upon pressurization of the cylinder below the piston.

To provide for an efficient return stroke, it is important for the space within the cylinder below the piston to be sealed as efficiently as possible to permit the build-up of air pressure required for maximized piston return responsiveness.

In a known arrangement for sealing the lower chamber, as set forth in U.S. Pat. No. 5,511,714, a mouth tool is provided with an extension portion which is forced into sealing relation within a recess provided in a stop member at the bottom of the drive cylinder. The stop member is formed from a block of resilient material confined by the drive cylinder. The seal between the mouth tool and the stop member is formed as a result of pure mechanical compression of the resilient material and the resultant inwardly biased force it applies to the mouth tool inserted into the recess. A problem with this arrangement is that when the lower cylinder is pressurized to move the drive piston upwardly during a return stroke, the pressure within the lower part of the cylinder operates to bias or flex the resilient stop member away from its sealing engagement with the mouth tool. It can be appreciated that after prolonged use of such tool under pressure and impact conditions, the seal between the mouth tool and the stop member may be compromised. Furthermore, the tolerances of the stop member and the mouth tool must be made sufficiently small at the sealing interface therebetween to enable the mouth tool to be properly sealed to the stop member while also permitting the mouth tool to be easily inserted in sealing relation with the stop member. More specifically, if the recess in the stop member is too large, it will not properly seal with the mouth tool. On the other hand, if the recess is too small, it becomes difficult to insert the mouth tool. It is, therefore, an object of the invention to provide a pneumatically operated fastener drive device that overcomes the problems noted above.

In accordance with this object, the present invention provides a pneumatically operated fastener drive device that comprises a housing assembly including a nose assembly defining a fastener drive track. A cylinder is disposed in the housing assembly, and a resilient bumper is disposed towards a bottom of the cylinder. A drive piston is slidably and sealingly mounted in the cylinder for movement through an operative cycle including a drive stroke and a return stroke. The drive piston engages the bumper at the end of the drive stroke. A fastener driving element is operatively connected to the piston. The fastener driving element extends through an opening in the bumper and is movable in the fastener drive track through a drive stroke in response to the drive stroke of the piston and a return stroke in response to the return stroke of the piston. A valve arrangement includes a normally closed main valve which is movable from its closed position to an opened position to allow air under pressure to communicate with an area within the cylinder above the piston to initiate and effect movement of the piston and fastener driving element through the fastener drive strokes thereof. An actuator and trigger member are operable to control the valve arrangement. The bumper has a sealing portion surrounding the opening in the bumper and disposed outwardly from the cylinder. The sealing portion has exterior surfaces disposed in engagement with adjacent surrounding surfaces of the nose assembly. The sealing portion being flexible outwardly under the force of air pressure within the cylinder below the piston during the return stroke of the piston so that the exterior surfaces of the sealing portion are biased in sealing relation with adjacent surrounding surfaces of the nose assembly.

Other objects and advantages of the present invention will become apparent from the following detailed description and drawings and appended claims.

DETAILED DESCRIPTION OF THE INVENTION

Figure 1A:
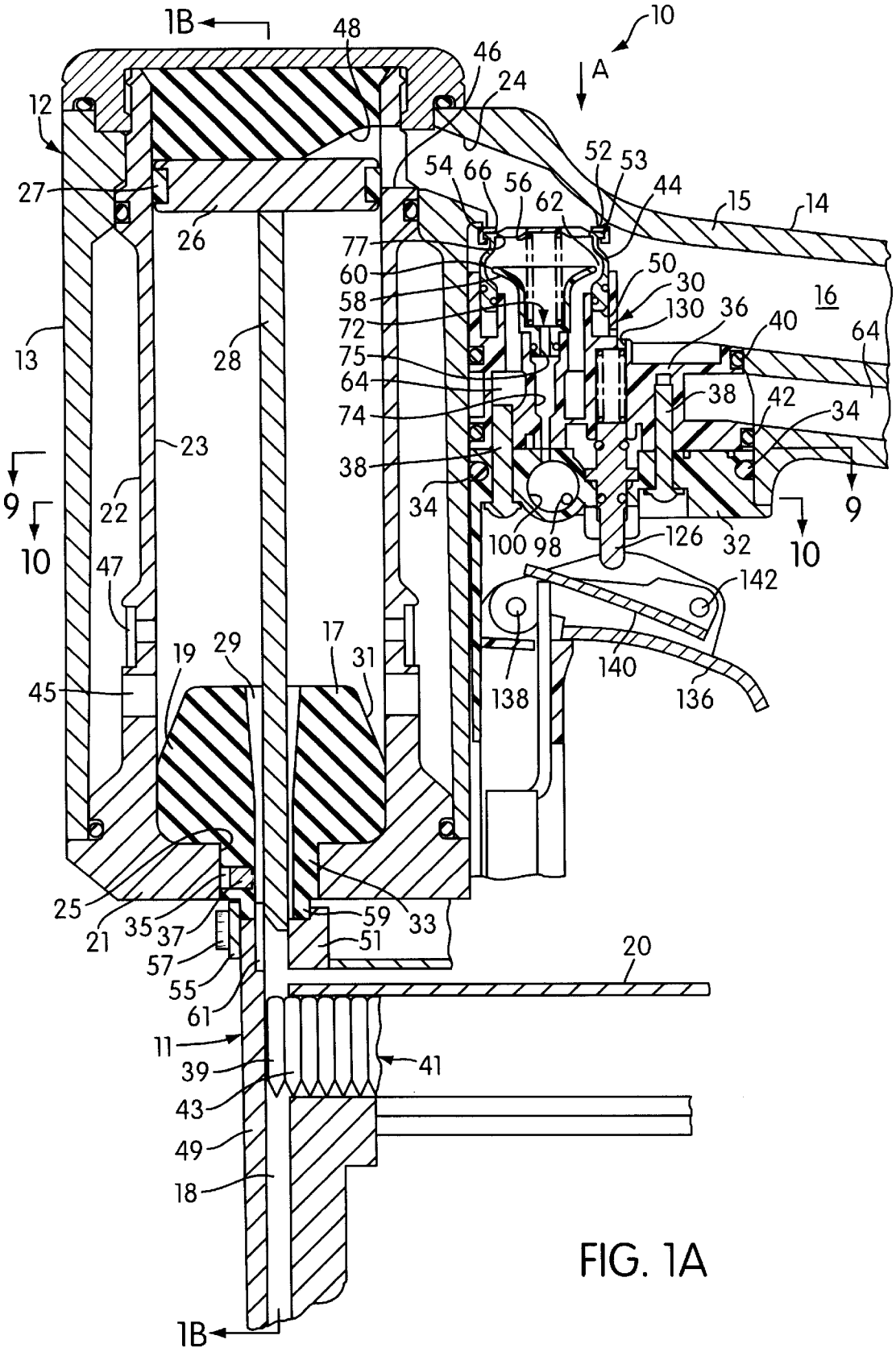
FIG. 1A is a partial sectional view of a fastener driving device including control valve structure provided in accordance with the principles of the present invention.
Figure 1B:
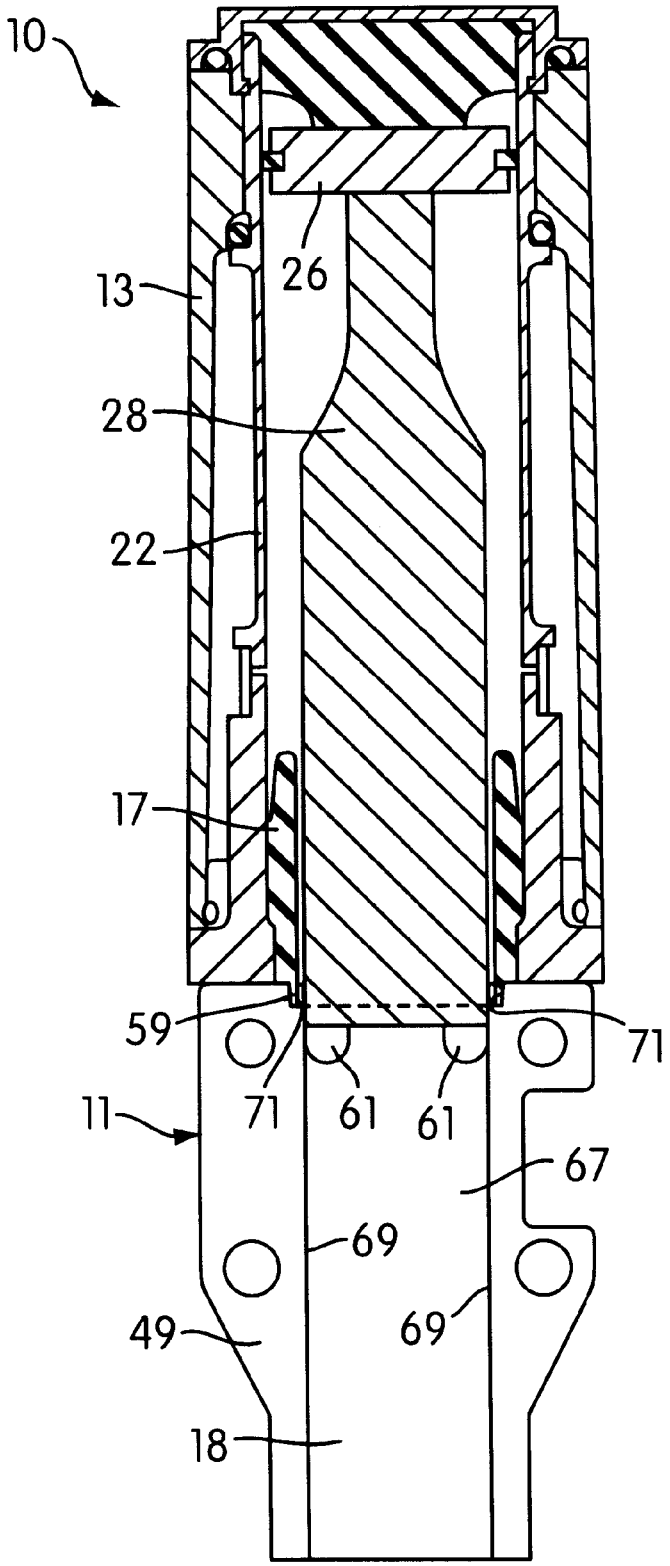
FIG. 1B is a sectional view taken across the line 1B—1B in FIG. 1A.

Referring now more particularly to the drawings, a pneumatically operated fastener driving device is shown, generally indicated at 10, in FIGS. 1A and 1B, which embodies the principles of the present invention. The device 10 includes the usual housing assembly, generally indicated at 12, having a cylindrical housing portion 13 and a frame housing portion 15, extending laterally from the cylindrical housing portion 13. A hand grip portion 14 of hollow configuration is defined in the frame housing portion 15, which constitutes a reservoir chamber 16 for air under pressure coming from a source which is communicated therewith. A metal nose assembly 11 is fixed to the housing assembly 12. The nose assembly 11 may optionally be considered separate or as part of the housing assembly 12. The metal nose assembly 11 defining a fastener drive track 18 which is adapted to receive laterally therein the leading fastener from a package of fasteners 41 mounted within a magazine assembly 20 of conventional construction and operation.

Mounted within the cylindrical housing portion 13 is a steel cylinder 22 which has its upper end disposed in communicating relation with the reservoir chamber 16 via passageway 24. The bottom end of cylinder 22 has a radially extending annular flange 21 which partially closes off the bottom of the cylinder, leaving a central opening 25. Mounted within the cylinder 22 is a piston 26 having a peripheral piston ring 27 made of a hardened plastic, preferably Meldin, material. The piston ring 27 is preferably discontinuous at a single given location and is disposed in sliding and sealing relation with the inner cylindrical surface 23 of the cylinder 22. Carried by the piston 26 is a fastener driving element 28 which is slidably mounted within the drive track and movable by the piston and cylinder unit through a cycle of operation which includes a drive stroke during which the fastener driving element 28 engages a fastener within the drive track and moves the same longitudinally outwardly into a workpiece, and a return stroke.

Also disposed within the cylinder 22, at the lower end thereof, is a resilient bumper 17, preferably made from urethane. The bumper 17 defines a central opening 29 through which the driving element 28 can extend and provides a lower stop for piston 26. Bumper 17 has a main portion 19 having an exterior surface which is sealed to the interior surface 23 of the cylinder 22. The bumper 17 further includes a reduced diameter portion 33 which extends into the central opening 25 in the bottom of cylinder 22. The reduced diameter portion 33 has a cylindrical bore 35 which extends perpendicularly to the central opening 29. The bore 35 is constructed and arranged to receive a magnet 37. The bore 35 has a reduced diameter adjacent the central opening 29 in the bumper 17 to prevent the magnet 37 from falling into the drive track 18. The magnet 37 is press fit into the bore 35 so as to prevent an air leak through the bore 35.

The magnet 37 is constructed and arranged to continuously attract the fastener driving element 28 to ensure that the driving element 28 contacts only the first fastener 39 within the supply of fasteners 41 in magazine 20 during the downward drive stroke of driving element 28. In other words, the magnet 37 biases the driving element 28 in the fastener feeding direction (to the left in FIG. 1) so that the driver element 28 contacts the first fastener 39 without contacting the next or second fastener 43 within supply 41. In addition, the magnet 37 functions to hold the piston 26 at the top of the drive stroke. More specifically, while the frictional engagement between piston ring 27 and surface 23 of cylinder 22 functions somewhat in maintaining the piston 26 at the top of the cylinder 22 after a return stroke, the magnet 37 ensures that the piston is held at such position against the force of gravity until the next burst of air is received above the piston 26 for a downward drive stroke.

Means are provided within the housing assembly 12 to effect the return stroke of the piston 26. For example, such means may be in the form of a conventional plenum chamber return system such as disclosed in U.S. Pat. No. 3,708,096, the disclosure of which is hereby incorporated by reference into the present specification. The cylinder 22 is provided with a passageway 45 and a check valve 47 in conventional fashion to effect the return stroke.

The previously described nose assembly 11 includes a metallic (preferably steel) nose piece or nose member 49 defining the length of the previously described fastener drive track 18. As can be appreciated in FIG. 1B, the nose member 49 defines three surfaces of the drive track 18. These three surfaces include a relatively longer surface 67 (in the horizontal direction), and two relatively shorter surfaces 69 on opposite sides of the long surface 67. The short surfaces 69 are generally parallel to one another and perpendicular to the longer surface 67. The length of the longer surface 67 in the horizontal direction is slightly larger than the width of the fastener driving element 28. The length of the shorter surfaces 69 is slightly larger than the thickness of the fastener driving element 28.

The nose assembly 11 further includes a metallic (preferably steel) wear plate 51 which closes off the drive track 18 (provides a fourth side to the drive track) at the upper end of the drive track. The nose assembly 11 further includes a metallic (preferably steel) nose plate 55 disposed at the upper end of the nose member 49 on the exterior surface thereof. The wear plate 51, nose member 49, and nose plate 55 are clamped together by a plurality bolts 57.

As shown, the reduced diameter portion 33 of the bumper 17 has a lower rectangular annular nipple or sealing portion 59. The sealing portion or nipple 59 protrudes outwardly below the cylinder 22 and into the nose assembly 11 so as to form a seal therewith. Particularly, the sealing portion 59 has four walls (two short and two long) disposed between the nose plate 55 and the wear plate 51. The four walls are interconnected to form a substantially rectangular slot through which the fastener driving element 28 can be received. The exterior surfaces of the side walls defining the sealing portion 59 are disposed in contact with the adjacent surfaces of the nose assembly 11. In particular, one of the long side walls of the sealing portion 59 has the exterior surface thereof engaging the wear plate 51, a second of the long side walls of the sealing portion 59 has the exterior surface thereof engaging the nose plate 55. The two short side walls of the sealing portion 59 has the exterior surfaces thereof engaging recessed portions 71 of the shorter surfaces 69 of nose member 49.

The long walls of the sealing portion 59 have lower longitudinal edge surfaces disposed on opposite sides of the drive track 18, one of which engages the wear plate 51, and the other of which engages an upper edge of the nose member 49.

It can be appreciated that the nose assembly 11 is assembled around the sealing portion 59 after the bumper 17 has been installed in the cylinder. The wear plate 51, nose member 49, and nose plate 55 are all positioned in their proper positions, after which the bolt 57 clamps these members to one another in surrounding relation to the sealing portion 59. The fact that the sealing portion 59 projects downwardly permits the nose assembly to be formed around the sealing portion 59.

In the relaxed state, the four walls forming the sealing portion 59 have a rectangular exterior diameter that is slightly larger than the adjacent interior surfaces of the nose assembly 11. As a result, the four walls of the sealing portion are slightly deformed when received by the metal members forming the nose assembly 11. It is not essential for complete peripheral sealing contact to exist between the sealing portion 59 and the nose assembly 11 in the relaxed state, as the sealing relation between these members is pressure sensitive and is highly effective in dynamic conditions as described below. It can thus be appreciated that the accuracy in the tolerances at the interface between the bumper 17 and the nose assembly 11 is not as critical as in the aforementioned prior art arrangements. In addition, the fact that the nose assembly 11 is formed around the sealing portion 59 and then clamped in place enables the tolerance requirements to be relaxed.

In accordance with the operation of the driving device, after the piston 26 engages the bumper 17 at the bottom of its stroke, the area in the cylinder 22 beneath the piston 26 is pressurized in a conventional manner to drive the piston and fastener driving element 28 towards the top of the cylinder 22. During the pressurization of the cylinder 22 below the piston 26, it is important that the integrity of the seal between the sealing portion 59 and the nose assembly 11 be maintained. To that effect, and in accordance with the principles of the present invention, the four walls forming the sealing portion 59 are thin so as to be slightly flexible under the force of air pressure beneath the piston 26. The pressurization of the cylinder 22 beneath the piston 26 is exposed to the interior surfaces forming the four walls of the sealing member 59 and thus tends to apply an outward force to the walls of sealing member 59 so as to tend to bias the exterior surfaces of the walls of sealing portion 59 into peripheral sealing contact engagement with the nose plate 55, wear plate 51, and nose member 49 to intensify the sealing contact between the nose assembly 11 and the bumper 17. As a result, the integrity of the seal between the bumper and the nose assembly 11 is intensified by the pressure within the cylinder below the piston during the return stroke of the piston. This seal can thus be maintained even after significantly prolonged periods of normal impact and pressure intensive operation.

Formed in the top of the nose member 49, adjacent the drive track 18 are a pair of recesses 61, which provide a bleed path for residual pressure in the cylinder 22 beneath the piston 26 after the piston 26 has reached the top of its drive stroke. This bleed path provided by recesses 61 is cut off after the driving element 28 passes beyond the recesses 61 after commencement of the drive stroke, so that this bleed path does not exist during the return stroke of the piston 26. While some air is permitted to escape beneath the piston 26 around the driving element 28 during the return stroke of the piston 26, it is desirable to minimize such air leakage to the extent possible by providing the superior sealing arrangement between the bumper and nose assembly as described. In an alternate configuration, it is contemplated that the recesses can be provided in the wear plate 51 rather than the nose member 49.

In order to effect the previously mentioned cycle of operation, there is provided control valve structure, generally indicated at 30, constructed in accordance with the present invention. The control valve structure 30 includes a housing unit, which, in the illustrated embodiment includes a trigger housing 32 removably coupled to the frame portion 15 by pin connections at 34, and a valve housing 36 secured to the trigger housing 32 by fasteners, preferably in the form of screws 38. Housings 32 and 36 are preferably molded from plastic material. O-rings 40 and 42 seal the valve housing 36 within the frame portion of the housing assembly 12.

Referring now more particularly to FIG. 1A, in the illustrated embodiment, the control valve structure 30 includes a main valve 44 mounted with respect to the valve housing 36 and associated with the passageway 24 between one end 46 of the cylinder 22, and the reservoir chamber 16. The main valve 44 is moveable between opened and closed positions to open and close the passageway 24 and has a first annular pressure responsive surface 50 and a second, opposing annular pressure responsive surface 52. When the main valve 44 is closed, a portion 53 of surface 52 extends beyond annular housing seat 54 and is exposed to reservoir pressure in the reservoir chamber 16. Spring structure, in the form of a coil spring 56 biases the main valve 44 to its closed position, together with reservoir pressure acting on surface 50. Thus, the force of the spring 56 plus the force due to pressure acting on surface 50 is greater than the force due to pressure acting on the portion 53 of the opposing surface 52, which results in the keeping the main valve 44 in its closed position. The spring 56 is disposed between a surface of an exhaust seal 58 and a surface of the main valve 44. The exhaust seal 58 is fixed to the valve housing 36 and an upper annular surface 60 thereof contacts an inner surface of the main valve 44 when the main valve is in its fully opened position, thereby closing an exhaust path 62. Exhaust path 62 communicates with the atmosphere via the exhaust 64.

A urethane seal member 66 is attached to the upper end of the main valve 44 and ensures proper sealing when the main valve 44 is closed. Thus, when the main valve 44 is in its closed position, surface 52 and thus seal member 66 of the main valve is in sealing engagement with seat 54 of the housing assembly 12. O-ring seals 70 (FIG. 3) are provided for sealing the main valve 44 within the valve housing 36.

A passageway, generally indicated at 72, is defined through the main valve 44 and the exhaust seal 58. The passageway 72 includes passage 74 of the valve housing 36, passage 76 of the trigger housing 32, passage 75 of the exhaust seal 58 and passages 77 defined in the top surface of the main valve 44. The passageway 72 is part of second passage structure which provides a pressure signal to the secondary valve structure, as will become apparent below.

A pressure chamber 78 (FIG. 2) is defined between the first pressure responsive surface 50 of the main valve 44, and a portion of the valve housing 36. The pressure chamber 78 is in communication with the high pressure in reservoir chamber 16 via a feed orifice 80 to bias the main valve 44 to its closed position. This high pressure in chamber 78 is dumped to atmosphere to open the main valve 44, as will be explained below.

Figure 2:
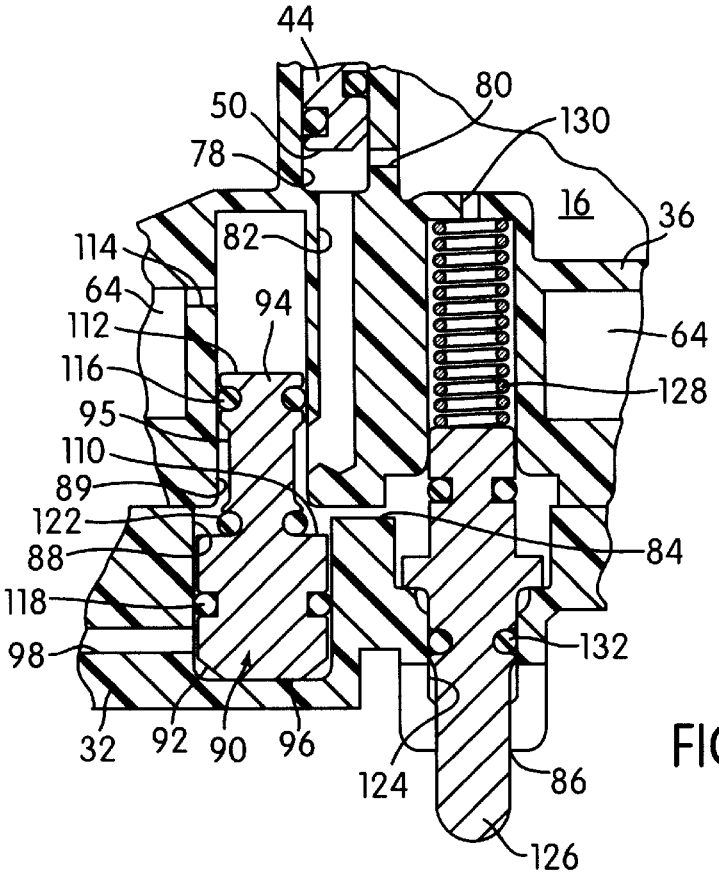
FIG. 2 is a partial sectional view of the control valve structure of FIG. 1 showing the relative positions of the main valve and secondary valve member when the device is at rest.

With reference to FIG. 2, first passage structure connects the pressure chamber 78 with an exhaust port 86. Passage 82, bores 88 and 89, bleed path 84 define the first passage structure between the pressure chamber 78 and the exhaust port 86, the function of which will be apparent below. It can be appreciated that the first passage structure may be of any configuration which permits communication between the pilot pressure chamber 78 and the exhaust port 86.

The control valve structure 30 includes a secondary valve member in the form of a shuttle valve 90 mounted with respect to the first passage structure in bore 88 of trigger housing 32 and bore 89 of valve housing 36 (FIG. 2). FIG. 2 shows the position of the shuttle valve 90 when the device 10 is at rest. The shuttle valve 90 is generally cylindrical and has a base portion 92 and a stem portion 94 extending from the base portion 92. The stem portion 94 has a reduced diameter portion 95, the function of which will become apparent below. The base portion 92 defines a first pressure receiving surface 96 which is in pressure communication with over-the-piston pressure, which is the pressure communicating with a piston chamber 48. This pressure may be exhaust pressure or high pressure, depending on what part of the cycle the device 10 is operating. Such communication is achieved since surface 96 communicates with port 98, which in turn communicates with bore 100, which is in communication with the passageway 72. The passageway 72 is open to passage 24 and thus open to the piston chamber 48. These passages define second passage structure providing communication between the shuttle valve 90 and the piston chamber 48. It can be appreciated that the second passage structure can be of any configuration which permits communication between the piston chamber and the secondary valve member.

Figure 9:
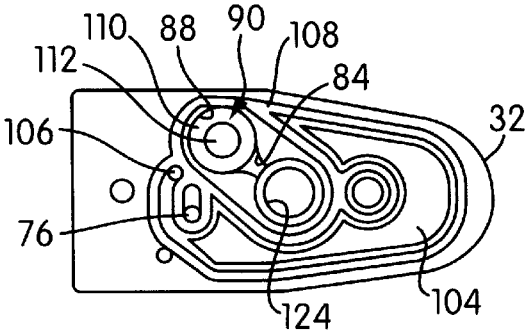
FIG. 9 is a view of the trigger housing of the control valve module taken along the line 9—9 of FIG. 1.
Figure 10:
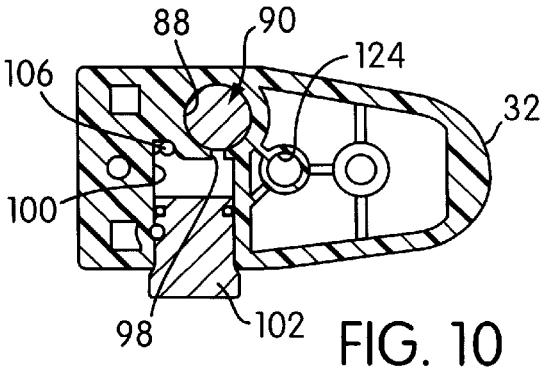
FIG. 10 is a sectional view taken along the line 10—10 of FIG. 1.

In the illustrated embodiment, a plug 102 (FIG. 10) is sealingly mounted in bore 100. When the valve housing 36 is coupled to the trigger housing 32, a pressure cavity 104 is defined. Port 106 is in communication with cavity 104 (FIG. 9) and communicates the pressure cavity 104 with the port 98 via bore 100. A seal member 108 provides a seal between the trigger housing 32 and the valve housing 36.

The shuttle valve 90 has a second pressure receiving surface 110 opposing the first pressure receiving surface 96 and in communication with the reservoir chamber 16 via passage 82 and the feed orifice 80. When the device 10 is at rest, reservoir pressure via port 130 also communicates with surface 110. Further, the stem portion 94 of the shuttle valve 90 includes a third pressure receiving surface 112 continuously exposed to the atmosphere via port 114. The surface area of annular surface 110 and annular surface 112 are each less than the surface area of annular surface 96. Port 114 communicates with the exhaust 64. As shown in FIG. 2, when the shuttle valve 90 is in its opened position normally biased by high pressure at surface 110, communicated through passage 82 via feed orifice 80 and via port 130, passage 82 communicates with the bleed path 84. This occurs since the high pressure air may pass around the reduced diameter portion 95 of the shuttle valve 90. An o-ring 116 prevents this high pressure air from escaping to atmosphere through port 114 while o-ring 118 isolates the passage 82 from port 98. Surface 96 is exposed to atmospheric pressure since over-the-piston pressure in port 98 is atmospheric pressure due to the exhaust path 62 being open.

Figure 3:
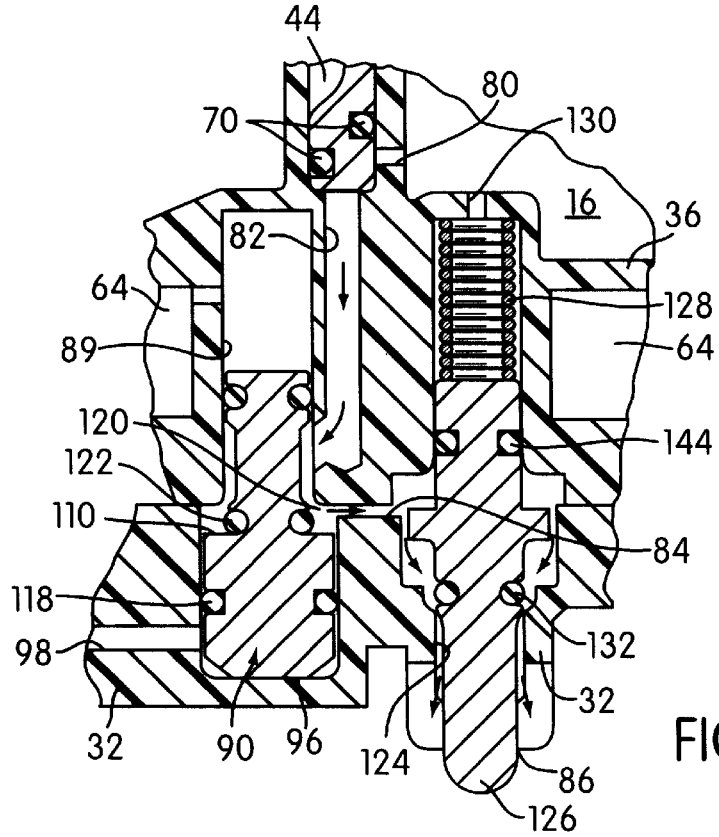
FIG. 3 is a sectional view similar to FIG. 2, showing an actuating member actuated moving the main valve to an opened position.
Figure 4:
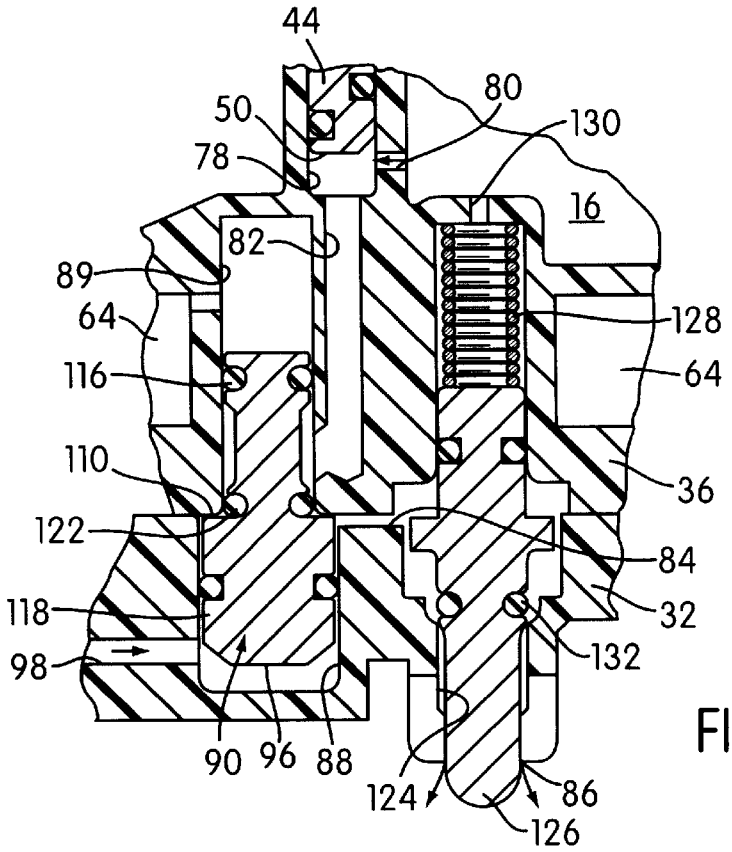
FIG. 4 is a view similar to FIG. 2, showing the main valve and secondary valve member in closed positions during a return stroke of the piston while the actuating member remains actuated.

With reference to FIG. 3, when the device 10 is actuated as explained more fully below, pressure in the pilot pressure chamber 78 is exhausted and port 130 is sealed, thereby permitting the main valve to open, initiating a fastener drive stroke. As a result, over-the-piston pressure or high pressure acts on surface 96 imposing a greater force than a force acting on surface 110 due to pressure communicating therewith; thus, the shuttle valve 90 is moved to its closed position (FIG. 4). In this position, surface 110 of the shuttle valve 90 engages surface 120 of the valve housing 36 so as to prevent communication between port 82 and the exhaust port 86. O-ring 116 seals off surface 112 and both O-rings 116 and 122 seal off port 82 creating a pneumatically balanced seal. O-ring 122 seals off port 86. Also, o-ring 118 prevents pressure in port 98 from communicating with the exhaust port 86. When the shuttle valve 90 is in this closed position, feed orifice 80 pressurizes pilot pressure chamber 78, closing the main valve, as will be explained in more detail below.

As shown in FIG. 2, the bleed path 84 connects the passage 82 and bores 88 and 89 with a trigger stem bore 124. The trigger stem bore 124 communicates with the exhaust port 86 and may be considered part of the exhaust port. A trigger stem 126, defining an actuator, is carried by the trigger housing 32 for movement from a normal, sealed position into an operative, unsealed position for initiating movement of the main valve 44 to its opened position, thereby initiating movement of the fastener driving element 28 through a fastener drive stroke. The actuator 126 is normally biased to its normal, sealed position by a spring 128, together with reservoir pressure exerted thereon via trigger port 130. Port 130 communicates with reservoir chamber 16. As shown in FIG. 2, in the sealed position, the actuator 126 engages a surface of the trigger housing 32 with an O-ring 132 compressed therebetween, sealing the exhaust port 86.

With reference to FIG. 1A, in the illustrated embodiment, the control valve structure 30 includes a trigger assembly including a trigger member 136 pivoted to the trigger housing 32 at pin 138 for manual movement from a normal, inoperative position into an operative position. The trigger assembly also includes a rocker arm 140 which is pivoted to the trigger member 136 via a pin 142. Upward movement of the trigger member 136 causes the rocker arm 140 to engage and move the actuator 126 from its sealed position to its operative, unsealed position.

The operation of the control valve structure and thus the device 10 will be appreciated with reference to FIGS. 1–10. As shown in FIG. 2, when the device 10 is at rest, reservoir pressure from feed orifice 80 acting on surface 50 biases the main valve 44 against seat 54 of the housing assembly 12 preventing reservoir pressure from entering the upper end 46 of the cylinder 22. The main valve 44 is biased upwardly since the area of pressure responsive surface 50 is greater than the surface area of portion 53 (FIG. 1A) extending beyond seat 54. High pressure in chamber 78 enters the passage 82 and bores 88 and 89 and biases the shuttle valve 90 to its opened position together with reservoir pressure from port 130. Thus, high pressure exerted on surface 110 of the shuttle valve 90 opens the shuttle valve. Pressure in port 98 is exhausting pressure since the piston chamber 48 is exposed to atmospheric pressure via the passageway 72 and the exhaust path 62. The actuating member 126 is biased to its normal, sealed position with exhaust port 86 closed.

As shown in FIG. 3, when the actuator 126 is moved upwardly by manual movement of the trigger member 136, exhaust port 86 is opened which dumps the pressure in the pilot pressure chamber 78 to atmosphere via the passage 82, bores 88 and 89 and bleed path 86. This causes the main valve 44 to shift to its opened position as shown in FIG. 3, permitting the high pressure to pass through passageway 24 and into the piston chamber 48 to cause the fastener driving element 28 to move through a drive stroke. The actuator 126 includes an upper o-ring 144 which seals off reservoir pressure directed from port 130 before the o-ring 132 is unsealed with respect to the trigger stem bore 124. At this time, over-the-piston pressure is high pressure which passes through the passageway 72 and into port 98.

As shown in FIG. 3, when the main valve 44 is opened fully, the force created by high pressure acting on pressure surface 52 (FIG. 1A) is greater than the force of the spring 56 at its compressed height plus the force created by atmospheric pressure acting on surface 50. In this position and with reference to FIG. 1A, it can be appreciated that the main valve 44 engages the annular surface 60 of the exhaust seal 58 which closes passageway 62 preventing pressure in the piston chamber 48 from exiting the device 10 through the exhaust 64.

Over-the-piston pressure air or high pressure air bleeds through the passageway 72 into bore 100 and through port 98 under the shuttle valve 90 and into port 106 and thus into cavity 104. Cavity 104 provides a volume for air to build which controls piston dwell at the bottom of its stroke. Cavity 104 provides adequate dwell to decay pressure in pilot pressure clamber 78. Over-the-piston pressure air builds in cavity 104 and communicates with surface 96 of the shuttle valve 90 via port 98, thus, shifting the shuttle valve 90 to its closed position, as shown in FIG. 4. This occurs since force created by over-the-piston pressure acting on surface 96 is greater than pressure acting on surface 110 and the atmospheric pressure acting on surface 112. Thus, as shown in FIG. 4, with the actuator 126 still actuated, during the return stroke of the fastener driving element, the over-the-piston pressure or high pressure in passage 98 shifts the shuttle valve 90 to its closed position preventing communication between passage 82 and the exhaust port 86. Chamber 78 is filled with reservoir pressure via feed orifice 80. The feed orifice is sized to control the piston dwell at the bottom of its stroke. High pressure air then shifts the main valve 44 to its closed position such that seal member 66 is engaged with seat 54 of the housing assembly 12 (FIG. 1A). Over-the-piston pressure exhausts through path 62 and through the exhaust 64. Over-the-piston pressure in cavity 104 bleeds through port 106 (FIG. 9) and then through passage 76 and through passageway 72, through path 62 and finally bleeds out through the exhaust 64. As noted above, the configuration of the shuttle valve 90 and o-rings 116 and 122 provides a pneumatically balanced seal. Thus, once the shuttle valve 90 is closed, it remains closed via 116, 122, and 118 o-ring friction until the trigger member is released, as explained below.

Figure 5:
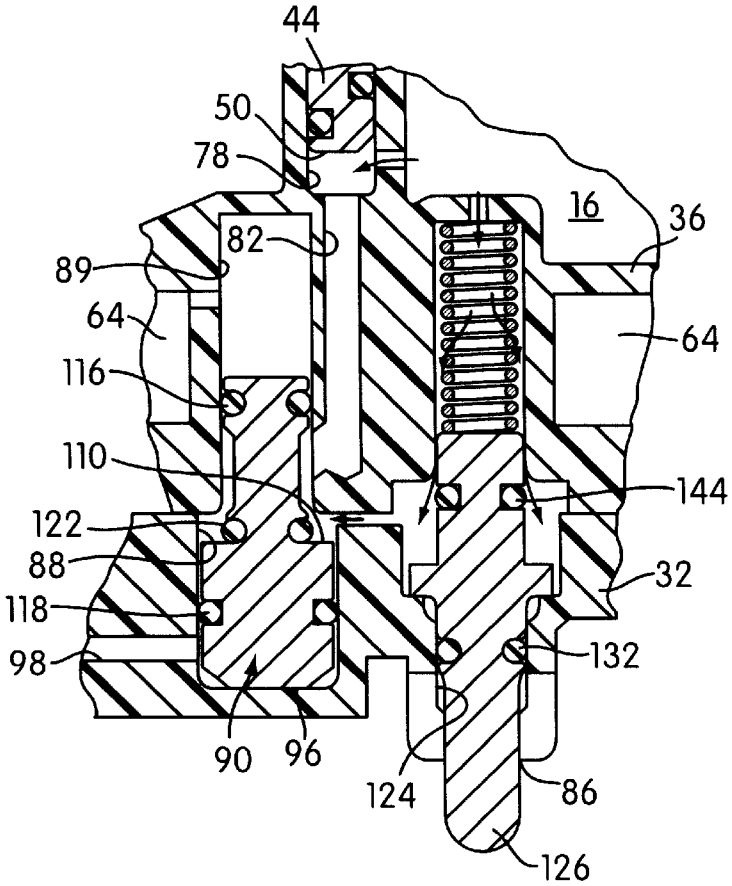
FIG. 5 is a view similar to FIG. 2, showing the actuating member released, with the main valve disposed in the closed position thereof and the secondary valve member returned to the opened position thereof.
Figure 6:
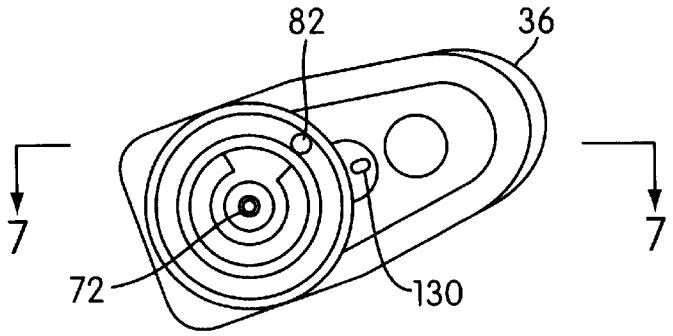
FIG. 6 is a view of a portion of the control valve module as seen in the direction of arrow A of FIG. 1, shown with the main valve removed for clarity of illustration.
Figure 7:
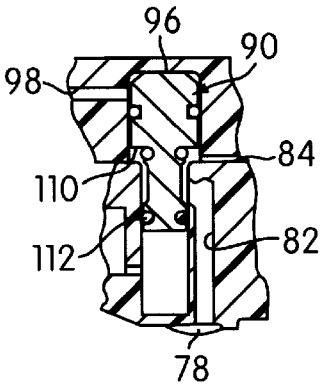
FIG. 7 is a partial sectional view taken along the line 7—7 of FIG. 6, showing the secondary valve member in an opened position.
Figure 8:
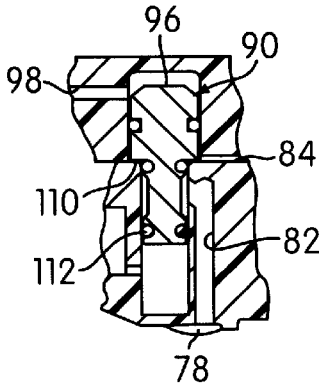
FIG. 8 is a partial sectional view taken along the line 7—7 in FIG. 6, showing the secondary valve member in a closed position.

With reference to FIG. 5, release of the trigger member 136 permits the actuator 126 to move to its sealed position. This causes high pressure air to bleed past o-ring 144 and be exerted on surface 110 of the shuttle valve 90, thereby biasing or resetting the shuttle valve 90 to its opened position, with the main valve 44 in the closed position thereof, as shown in FIG. 5. Over-the-piston pressure in passage 98 and under the shuttle valve 90 is exhaust pressure since the main valve 44 is closed and the exhaust path 62 is opened. Thus, it can be appreciated that one full cycle is completed while the trigger member 136 is actuated. Release of the trigger member 136 resets the shuttle valve 90 and the device 10 is ready to be actuated again.

It can be appreciated that by positioning the main valve 44 in the frame of the device 10, the overall tool height is reduced. Further, since in the illustrated embodiment, the control valve structure 30 is in the form of a single unit, removable from the housing 12, the device 10 is easy to assembly and service.

It can also be appreciated that the main valve and shuttle valve may be arranged in various positions with respect to the housing and may have various configurations, yet perform the same function as disclosed above. In particular, with reference to FIG. 11, it can be appreciated that the main valve 244 may be disposed above the cylinder 222. As shown, the main valve 244 is generally identical to that of the embodiment of FIG. 1A, but is in an inverted position above the cylinder 222. The shuttle valve (not shown) is mounted in housing assembly 230, similarly to that of the embodiment of FIG. 1A. Feed orifice 280 connects the pilot pressure chamber 278 with the reservoir 16. Passage 282 communicates with the exhaust port 86 when the shuttle valve is in its opened position, as in the embodiment of FIG. 1A. An over-the-piston feed passageway 272 is provided which communicates the over-the-piston pressure in chamber 148 with the shuttle valve in the manner discussed above. Thus, when the trigger member 136 is pulled moving the actuator 126 upwardly, the device will complete one full cycle as described above, so long as the trigger member 136 remains pulled.

FIG. 12 shows yet another embodiment of the present invention wherein like parts are designated with like numerals. As shown, the device 300 includes a shuttle valve 390 is disposed in the tool housing and has a conventional trigger valve assembly 336. The main valve 244 is disposed above the cylinder 222 an is identical to valve 244 of FIG. 11. The trigger valve assembly 336 may be of the type disclosed in, for example, U.S. Pat. No. 5,083,694, the disclosure of which is hereby incorporated by reference into the present specification. Chamber 340 above the shuttle valve 390 is exposed to atmosphere via port 314. Over-the-piston pressure is communicated with the shuttle valve via port 398. Passage 382 is similar to passage 82 discussed above. When the trigger member 136 is pulled to move the actuator 326, pressure in the pilot pressure chamber 278 is dumped to atmosphere initiating the operating cycle of the device. Pressure from port 384 will reset the shuttle valve 390 when the actuator 326 is released, by directing high pressure to surface 110 of the shuttle valve 390.

It can thus be seen that the main valve and shuttle valve arrangement ensures that one full cycle of operation is completed while the trigger member remains actuated. Release of the trigger member resets the device 10 for another full cycle. Since the fastener driving element is only exposed for a very brief time to drive the fastener, damage to the fastener driving element may be prevented, even if the operator holds the trigger for a time longer than necessary to drive the fastener. Further, after the drive stroke, pressure over the piston will not reach line pressure with the trigger member actuated. Thus, exhausting the pressure over the piston during the return stroke results in quieter tool operation.

It should be appreciated that while the present invention has been described as applied to a full cycle valving arrangement, this is for exemplary purposes only. The valving arrangement could be any conventional type, such as a single valve only arrangement (without a secondary valve), and can be the standard valve type such as that disclosed in Ser. No. 08/559,240, filed Nov. 16, 1995, and hereby incorporated by reference. Also, an automatic valve arrangement is also contemplated by this invention.

While the invention has been described in connection with what is presently considered to be the most practical and preferred embodiment, it is understood that the invention is not limited to the disclosed embodiment, but, on the contrary, is intended to cover various modifications and equivalent arrangements included within the spirit and scope of the appended claims.

What is claimed is:

1. A pneumatically operated fastener drive device comprising:

a housing assembly including a nose assembly defining a fastener drive track;

a cylinder disposed in said housing assembly;

a resilient bumper disposed towards a bottom of said cylinder;

a drive piston slidably and sealingly mounted in said cylinder for movement through an operative cycle including a drive stroke and a return stroke, said drive piston engaging said bumper at the end of said drive stroke;

a fastener driving element operatively connected to said piston, said fastener driving element extending through an opening in said bumper and movable in said fastener drive track through a drive stroke in response to the drive stroke of the piston and a return stroke in response to the return stroke of the piston;

a valve arrangement including a normally closed main valve which is movable from its closed position to an opened position to allow a supply of air pressure to communicate with an area within the cylinder above the piston to initiate and effect movement of the piston and fastener driving element through the fastener drive strokes thereof;

an actuator and trigger member operable to control said valve arrangement;

said bumper having a sealing portion surrounding said opening in the bumper and disposed outwardly from said cylinder, said sealing portion having exterior surfaces disposed in engagement with adjacent surrounding surfaces of said nose assembly, said sealing portion being flexible outwardly under the force of air pressure within said cylinder below said piston during the return stroke of said piston so that said exterior surfaces of said sealing portion are biased in sealing relation with said adjacent surrounding surfaces of said nose assembly.

2. The pneumatically operated fastener driving device according to claim 1, further comprising a magnet disposed within said bumper.

3. The pneumatically operated fastener driving device according to claim 2, wherein said magnet continuously biases said fastener driving element in a direction forward of a leading fastener and away from a second fastener within a supply of fasteners so as to enable said fastener driving element to engage said leading fastener during said drive stroke thereof without engaging said second fastener.

4. The pneumatically operated fastener according to claim 2, wherein said magnet maintains the piston at the top of said cylinder against the force of gravity at the end of said return stroke of said piston.

5. A pneumatically operated fastener according to claim 1, wherein said valve arrangement further comprises a secondary valve, said secondary valve being movable from an opened position thereof to a closed position thereof to cause said main valve to move from its opened position back to its closed position, thereby completing one operative cycle while said trigger and actuator are in said operative position thereof, said secondary valve returning to said opened position thereof when said trigger and actuator are moved to an inoperative position.

6. A pneumatically operated fastener according to claim 1, wherein said nose assembly comprises a plurality of metal members clamped together to form said adjacent surrounding surfaces engaging said sealing portion.

7. A pneumatically operated fastener according to claim 6, wherein said adjacent surrounding surfaces form a rectangular opening at the top of said fastener drive track.

8. A pneumatically operated fastener according to claim 7, wherein said sealing portion comprises four flexible walls formed in a rectangular configuration, said flexible walls disposing said exterior surfaces of said sealing portion into a rectangular configuration for engaging said surrounding surfaces forming said rectangular opening.

9. A pneumatically operated fastener according to claim 8, wherein said exterior surfaces of said sealing portion includes two elongate surfaces formed by two parallel elongated flexible walls of said four walls, and two truncated surfaces formed by two parallel truncated flexible walls of said four walls, wherein said nose assembly includes a wear plate engaging a first of said elongate surfaces, a nose plate engaging a second of said elongate surfaces, and a nose member having opposing surfaces engaging said two truncated surfaces, said wear plate, said nose plate, and nose member be secured to one another in surrounding relation to said four flexible walls by an appropriate fastening structure.

* * * * *